US012474045B2

(12) United States Patent
Rabbitt et al.

(10) Patent No.: US 12,474,045 B2
(45) Date of Patent: Nov. 18, 2025

(54) BURN CONTROL APPARATUS FOR SOLID FUEL

(71) Applicant: Zippo Manufacturing Company, Bradford, PA (US)

(72) Inventors: William Eugene Rabbitt, Chesterland, OH (US); Robert F. Soreo, Cleveland Heights, OH (US)

(73) Assignee: Zippo Manufacturing Company, Bradford, PA (US)

( * ) Notice: Subject to any disclaimer, the term of this patent is extended or adjusted under 35 U.S.C. 154(b) by 602 days.

(21) Appl. No.: 17/992,210

(22) Filed: Nov. 22, 2022

(65) Prior Publication Data

US 2024/0167677 A1 May 23, 2024

(51) Int. Cl.
*F23B 50/00* (2006.01)

(52) U.S. Cl.
CPC ..... *F23B 1/36* (2013.01); *F23B 2700/037* (2013.01)

(58) Field of Classification Search
CPC ..... F23B 1/36; F23B 2700/037; F23B 60/00; F23D 3/16; F23D 3/26
See application file for complete search history.

(56) References Cited

U.S. PATENT DOCUMENTS

| | | | | |
|---|---|---|---|---|
| 2,056,605 | A * | 10/1936 | Guilfoil | F21V 37/00 431/291 |
| 5,193,994 | A * | 3/1993 | Schirneker | F21S 13/12 431/297 |
| 6,264,345 | B1 * | 7/2001 | Griffel | F23D 3/16 362/172 |
| 2011/0214663 | A1 | 9/2011 | Cox | |
| 2013/0011800 | A1 | 1/2013 | Chen | |
| 2013/0232862 | A1 | 9/2013 | Wilgus et al. | |
| 2016/0223186 | A1 * | 8/2016 | Azar | F21V 37/002 |
| 2021/0199302 | A1 | 7/2021 | Stone | |

FOREIGN PATENT DOCUMENTS

CN 2533393 Y 1/2003

* cited by examiner

*Primary Examiner* — David J Laux
(74) *Attorney, Agent, or Firm* — Hodgson Russ LLP

(57) ABSTRACT

An apparatus in which a solid fuel mass is burned controls the burn rate to slow the burning process and extend the lifespan of the solid fuel mass. The apparatus has a base cup configured to receive a lower portion of the solid fuel mass, and a descent cup configured to receive an upper portion of the solid fuel mass, wherein the descent cup includes a flame orifice. The descent cup is telescopically associated with the base cup and moves toward the base cup as the solid fuel mass is burned, and a flame produced as the solid fuel mass is burned extends outwardly from the flame orifice of the descent cup.

13 Claims, 9 Drawing Sheets

BURN CONTROL APPARATUS FOR SOLID FUEL

FIELD OF THE DISCLOSURE

The present disclosure relates to an apparatus for controlling the burn rate of solid fuel to prolong a flame-producing lifespan of the solid fuel.

BACKGROUND OF THE DISCLOSURE

Products such as decorative patio and garden torches and tabletop lanterns are known to burn alcohol-based gel or liquid fuel to produce an aesthetically-pleasing illuminating flame. In products of this type, the fuel is typically contained in a can having a lid that is difficult to reseal after opening. By design, the fuel can is intended for a single continuous use, and commonly lasts for about two hours once ignited. The use of gel or liquid fuel presents a safety hazard because the ignited fuel may spill and disperse across surfaces. For example, if a garden torch or table supporting a lantern is inadvertently bumped and fuel is spilled, the spilled fuel may spread the flame to persons, pets, or flammable objects.

It would be advantageous to use a solid fuel mass, such as an ethanol-based solid fuel mass, instead of a gel or liquid fuel. Ethanol-based solid fuel pellets are known for use as a fire-starter for campfires and the like. A solid fuel mass would improve safety by eliminating spillage risk, and would reduce waste by facilitating multiple intermittent uses with one fuel supply. However, a drawback weighing against replacing a gel or liquid fuel with an ethanol-based solid fuel mass is that the solid fuel mass exposed to surrounding air burns at a faster rate, thereby significantly decreasing the lifespan of the lantern or torch flame as compared to using a gel or liquid fuel.

Therefore, an apparatus for controlling the burn rate of a solid fuel mass is needed.

SUMMARY OF THE DISCLOSURE

The present disclosure provides an apparatus in which a solid fuel mass is burned, wherein the burn rate of the solid fuel mass is controlled to slow the burning process and extend the lifespan of the solid fuel mass. According to an embodiment of the present disclosure, the apparatus comprises a base cup configured to receive a lower portion of the solid fuel mass, and a descent cup configured to receive an upper portion of the solid fuel mass, wherein the descent cup includes at least one flame orifice. The descent cup is telescopically associated with the base cup and moves toward the base cup as the solid fuel mass is burned, and a flame produced as the solid fuel mass is burned extends outwardly from each flame orifice of the descent cup.

The base cup may have an external cylindrical shape defined by an outer diameter, and the descent cup may have an internal cylindrical shape defined by an inner diameter greater than the outer diameter of the base cup. The descent cup may include a top wall for contacting the solid fuel mass. A flame orifice may be arranged to extend through the top wall of the descent cup. When a height of the solid fuel mass decreases to a level lower than a top rim of the base cup as the solid fuel mass is burned, the top wall of the descent cup may engage the top rim of the base cup such that the descent cup ceases moving toward the base cup. The apparatus may further comprise a housing containing the base cup and the descent cup.

The present disclosure also provides a method of burning a solid fuel mass. In an embodiment of the present disclosure, the method comprises placing a lower portion of the solid fuel mass in a base cup, placing a descent cup including a flame orifice over an upper portion of the solid fuel mass, igniting the solid fuel mass such that a flame extends outwardly from the flame orifice of the descent cup, and allowing the descent cup to descend toward the base cup as the solid fuel mass burns. The method may further comprise stopping the descent of the descent cup once a height of the solid fuel mass decreases to a level below a height of the base cup. The method may also comprise applying a vortex air flow to the flame.

BRIEF DESCRIPTION OF THE DRAWING VIEWS

The nature and mode of operation of the present disclosure will now be more fully described in the following detailed description taken with the accompanying drawing figures, in which.

DETAILED DESCRIPTION

FIGS. 1-5 show an apparatus 10 formed in accordance with an embodiment of the present disclosure that may be utilized for burning a solid fuel mass SFM received therein. For example, apparatus 10 may be a decorative item positionable on a tabletop or other support surface, or on a ground-engaging support pole, to provide an illuminating and ornamental flame when the solid fuel mass SFM is ignited and burned. Solid fuel mass SFM may be a consumable solid fuel mass of a size and shape suitable for receipt by apparatus 10. By way of non-limiting example, solid fuel mass SFM may be an ethanol-based solid fuel mass or other chemical-based solid fuel mass.

Apparatus 10 generally comprises a base cup 20 configured to receive a lower portion of solid fuel mass SFM, and a descent cup 30 configured to receive an upper portion of the solid fuel mass. Descent cup 30 includes at least one flame orifice 32. As will be clear from description below, descent cup 30 is telescopically associated with base cup 20 and moves toward base cup 20 as solid fuel mass SFM is burned. As solid fuel mass SFM is burned, a flame produced by the burning fuel extends outwardly from flame orifice 32 of descent cup 30.

Figure 7B:
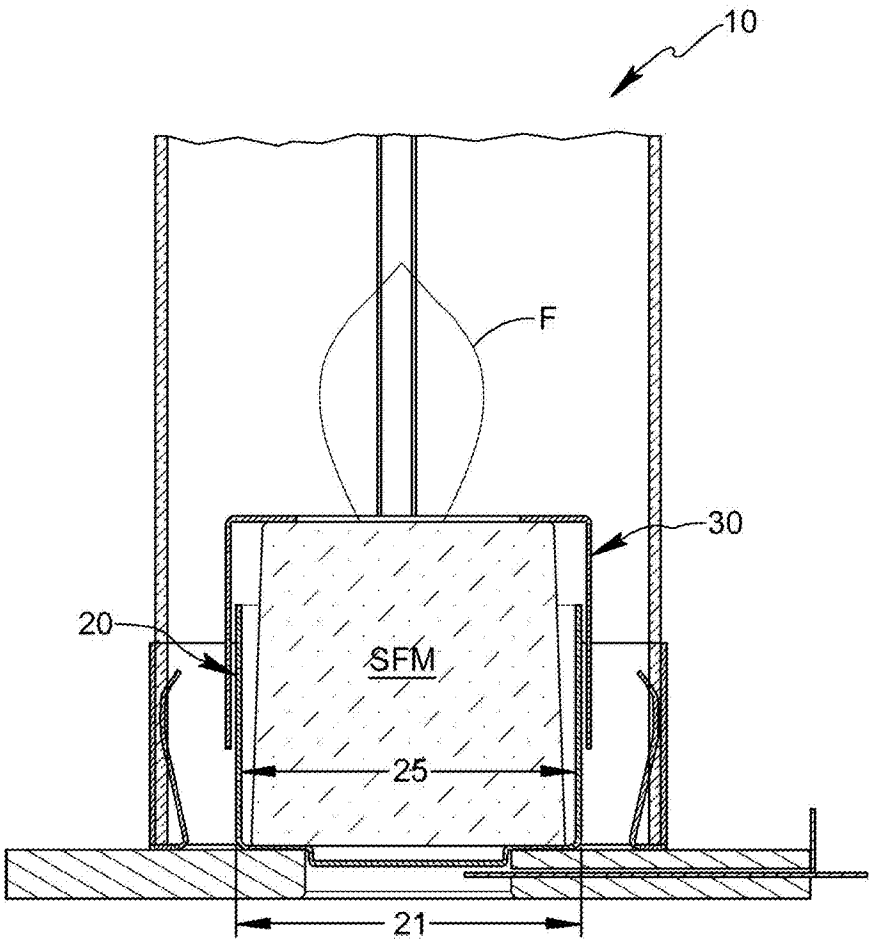
FIG. 7B is a cross-sectional view similar to that of FIG. 7A, wherein the solid fuel mass is partially expended by burning.

As illustrated in the drawing figures, base cup 20 may have an external cylindrical shape defined by an outer diameter 21 (see FIG. 7B), and may include an internal cavity 24 having a cylindrical shape defined by an inner diameter 25 (see FIG. 7B). Base cup 20 may further include a bottom wall 26 having a downward depression 27, a sidewall 28 extending upwardly from bottom wall 26, and a rim 29 at a top end of sidewall 28. As further illustrated in the drawing figures, descent cup 30 may include an internal cavity 34 having a cylindrical shape defined by an inner diameter 35 (see FIG. 7A) which is greater than the outer diameter 21 of base cup 20. Flame orifice 32 of descent cup 30 communicates with internal cavity 34. In the illustrated embodiment wherein internal cavity 24 of base cup 20 and internal cavity 34 of descent cup 30 are cylindrically shaped, solid fuel mass SFM may have a generally cylindrical shape or frustoconical shape sized for receipt within internal cavity 24 of base cup 20. While easily-manufactured cylindrical shapes are shown and described for base cup 20, internal cavity 24, descent cup 30, internal cavity 34, and solid fuel mass SFM, non-cylindrical shapes may be used without straying from the present disclosure.

Descent cup 30 may include a top wall 36 having an inner surface for contacting solid fuel mass SFM, and a sidewall 38 depending from top wall 36. Flame orifice 32 may extend through top wall 36 of descent cup 30. Alternatively, or additionally, flame orifice 32 and/or additional flame orifices (not shown) may extend through an upper region of sidewall 38.

Figure 1:
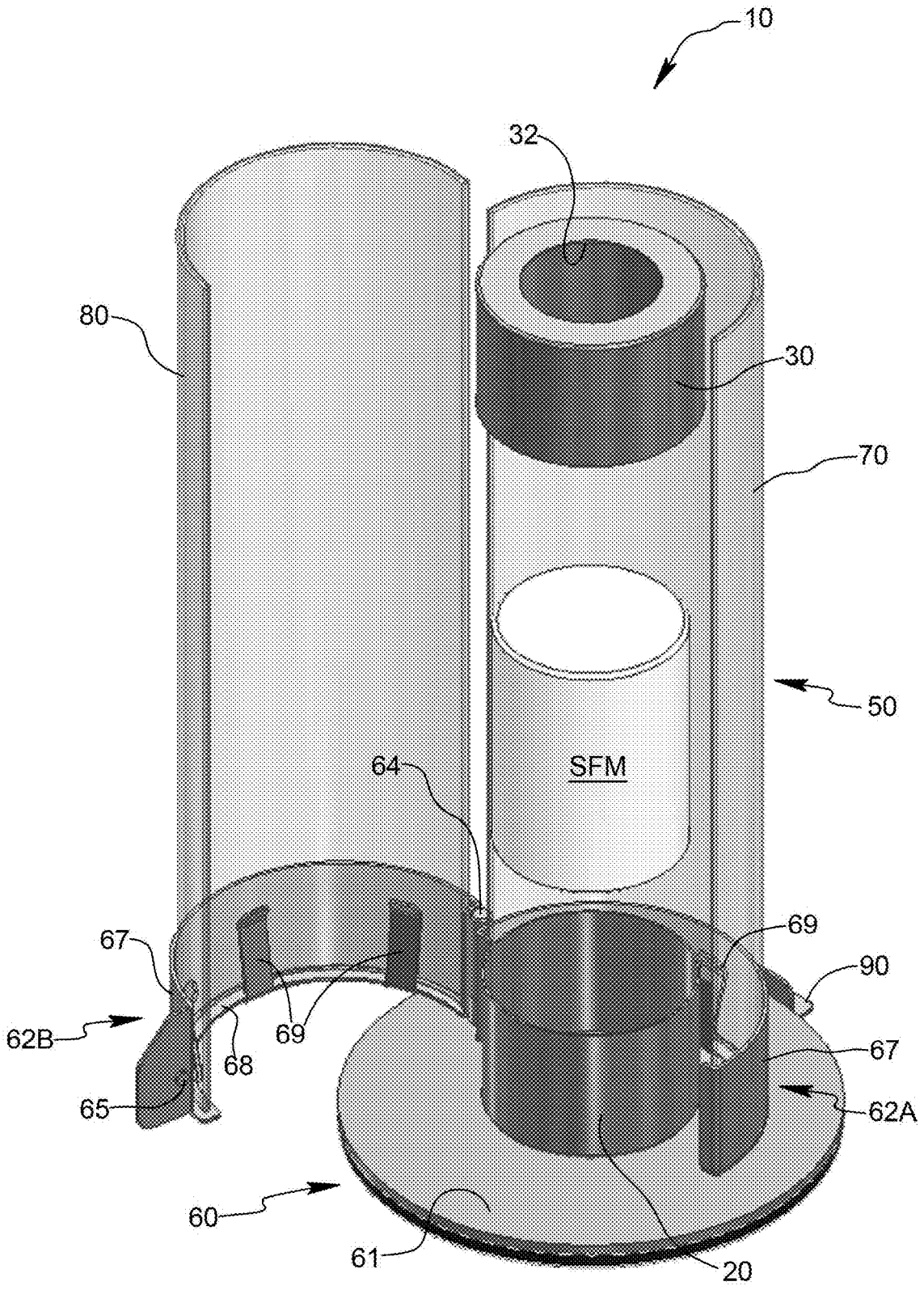
FIG. 1 is an exploded perspective view showing an apparatus in which a solid fuel mass is burned according to an embodiment of the present disclosure.
Figure 2:
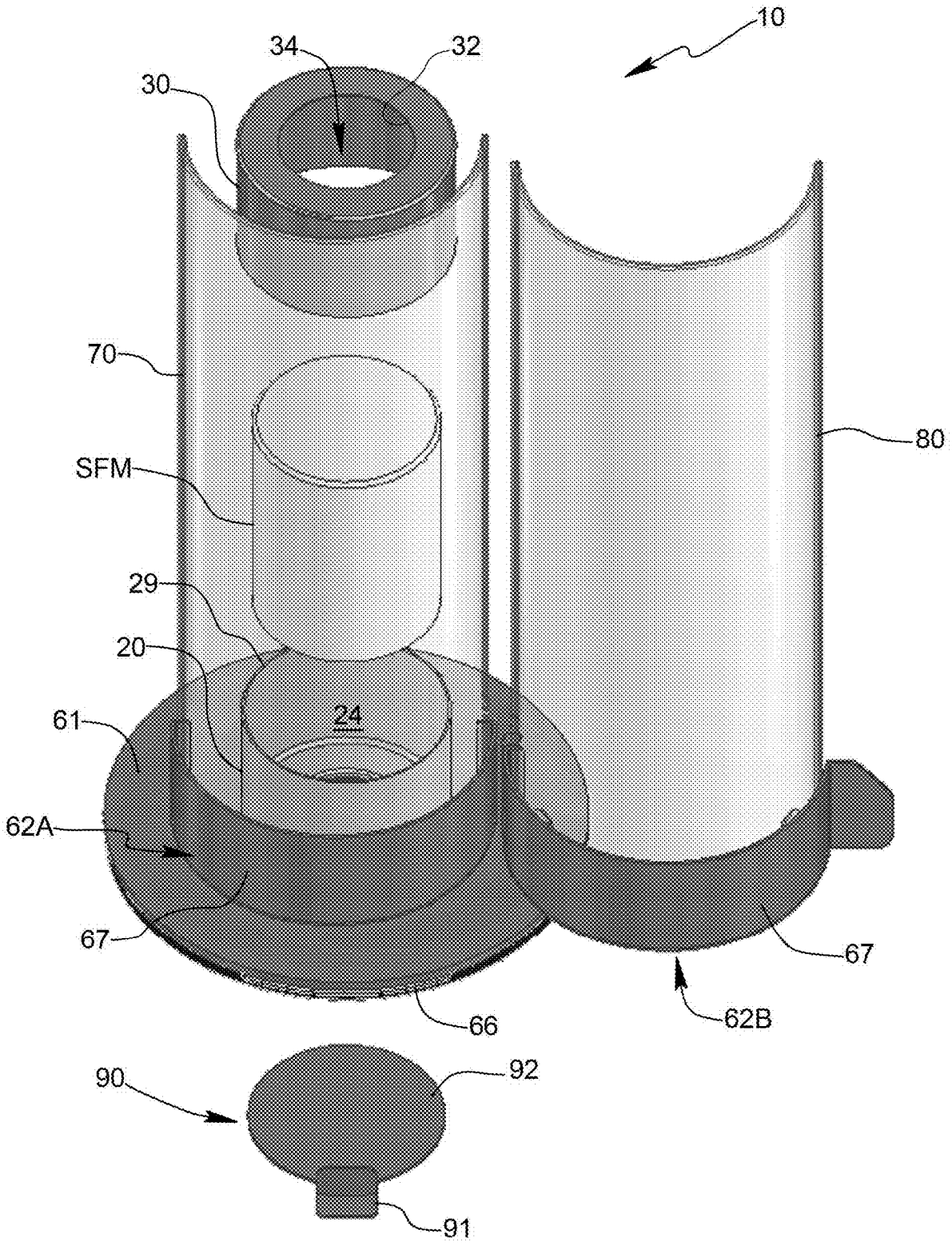
FIG. 2 is another exploded perspective view of the apparatus shown in FIG. 1.
Figure 3:
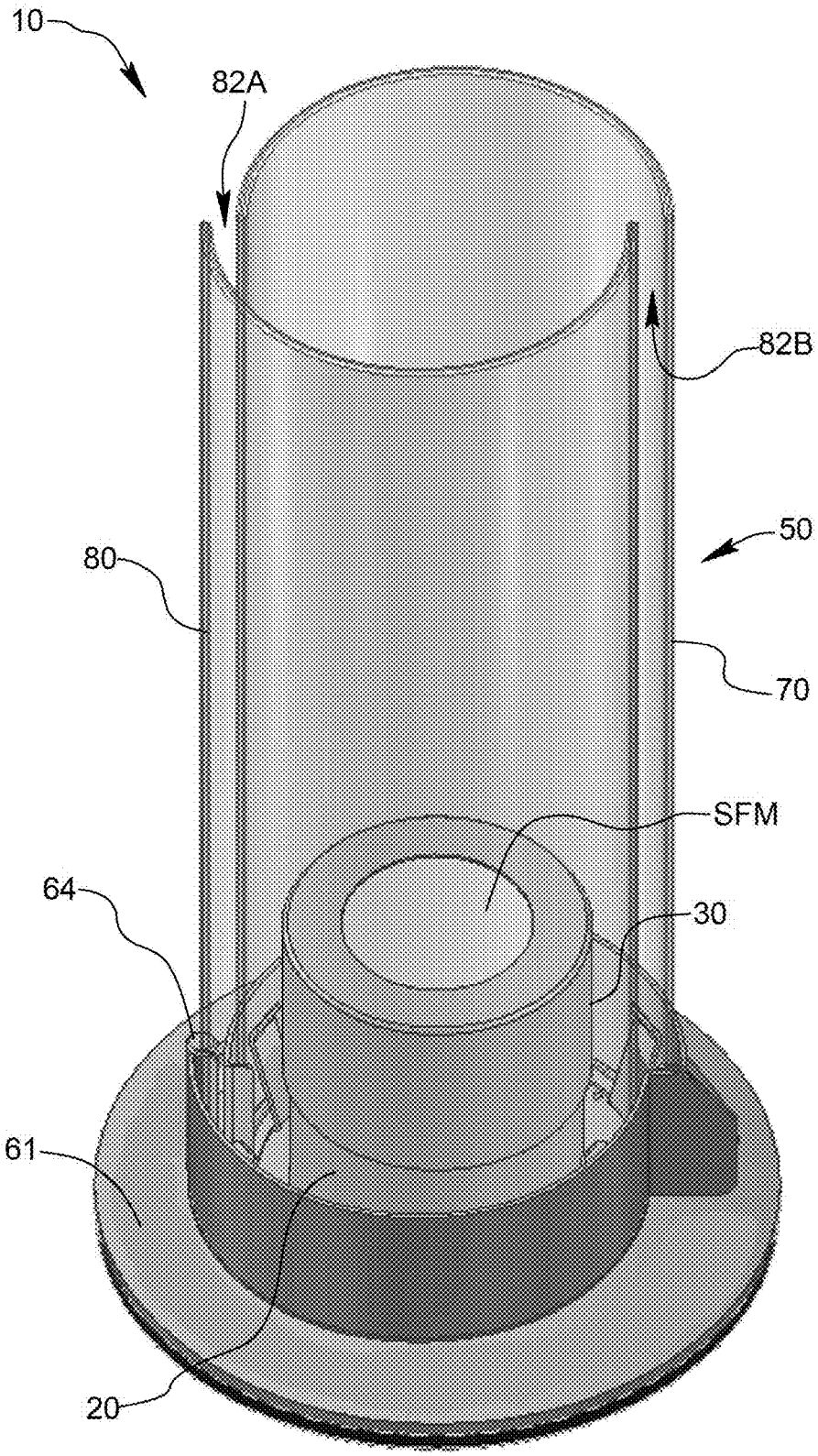
FIG. 3 is a perspective view of the apparatus shown in FIG. 1 loaded with a solid fuel mass, wherein a second wall portion of a housing of the apparatus is shown in a closed position relative to a first wall portion of the housing.
Figure 4:
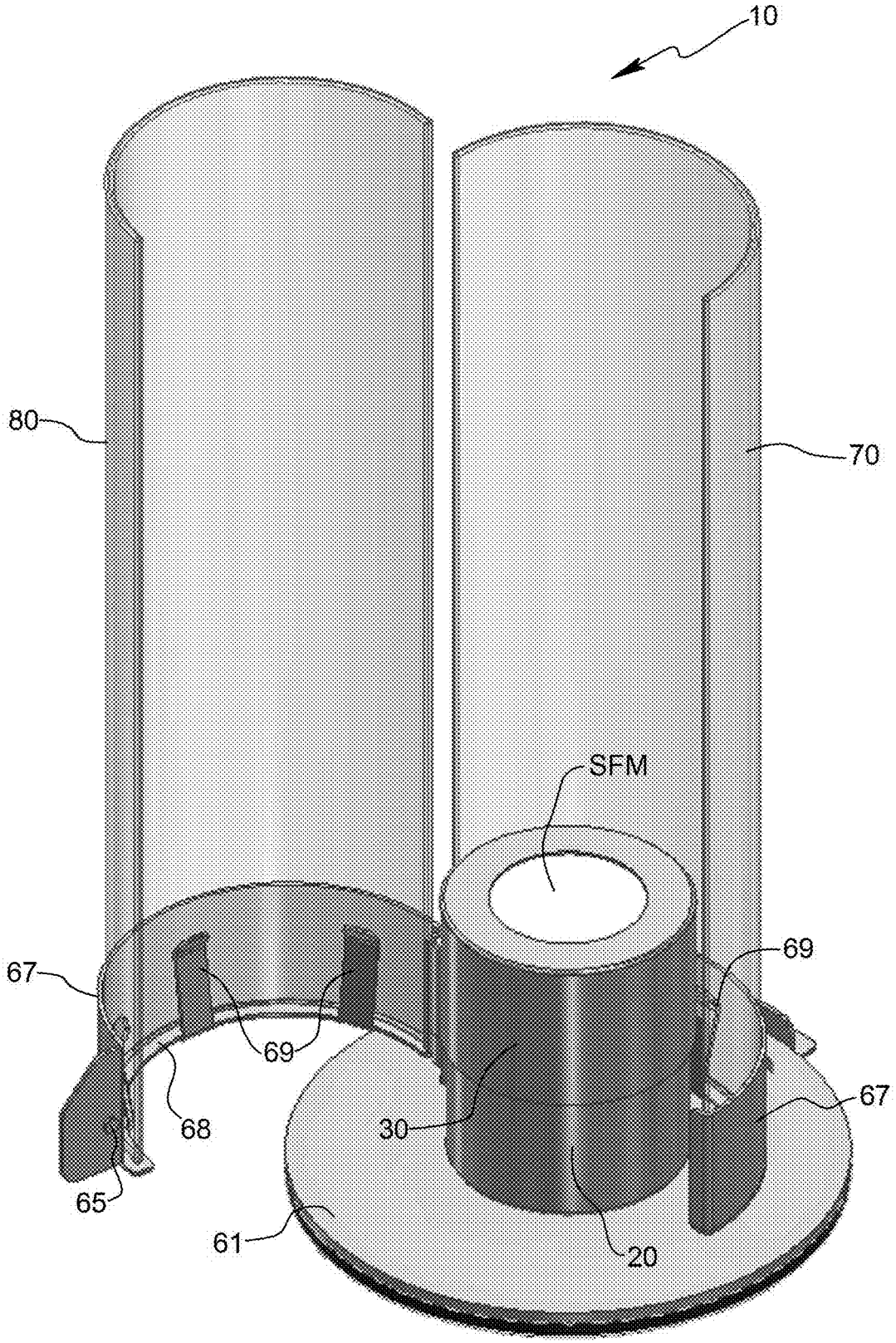
FIG. 4 is a perspective view similar to that of FIG. 3, wherein the second wall portion of the housing is shown in an open position relative to the first wall portion of the housing.
Figure 5:
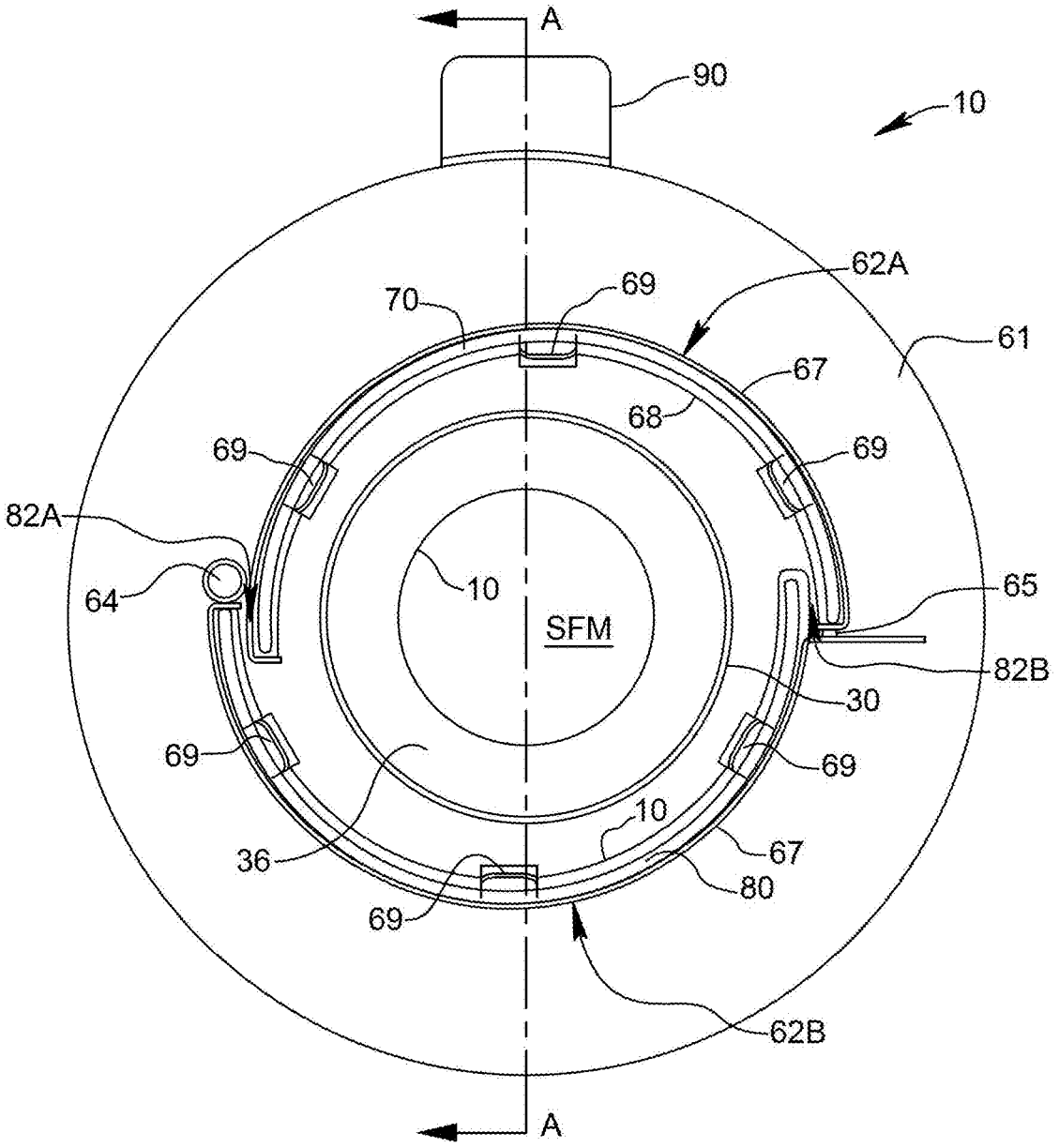
FIG. 5 is a top plan view of the apparatus shown in FIG. 1, wherein the second wall portion of the housing is shown in the closed position relative to the first wall portion of the housing.
Figure 6:
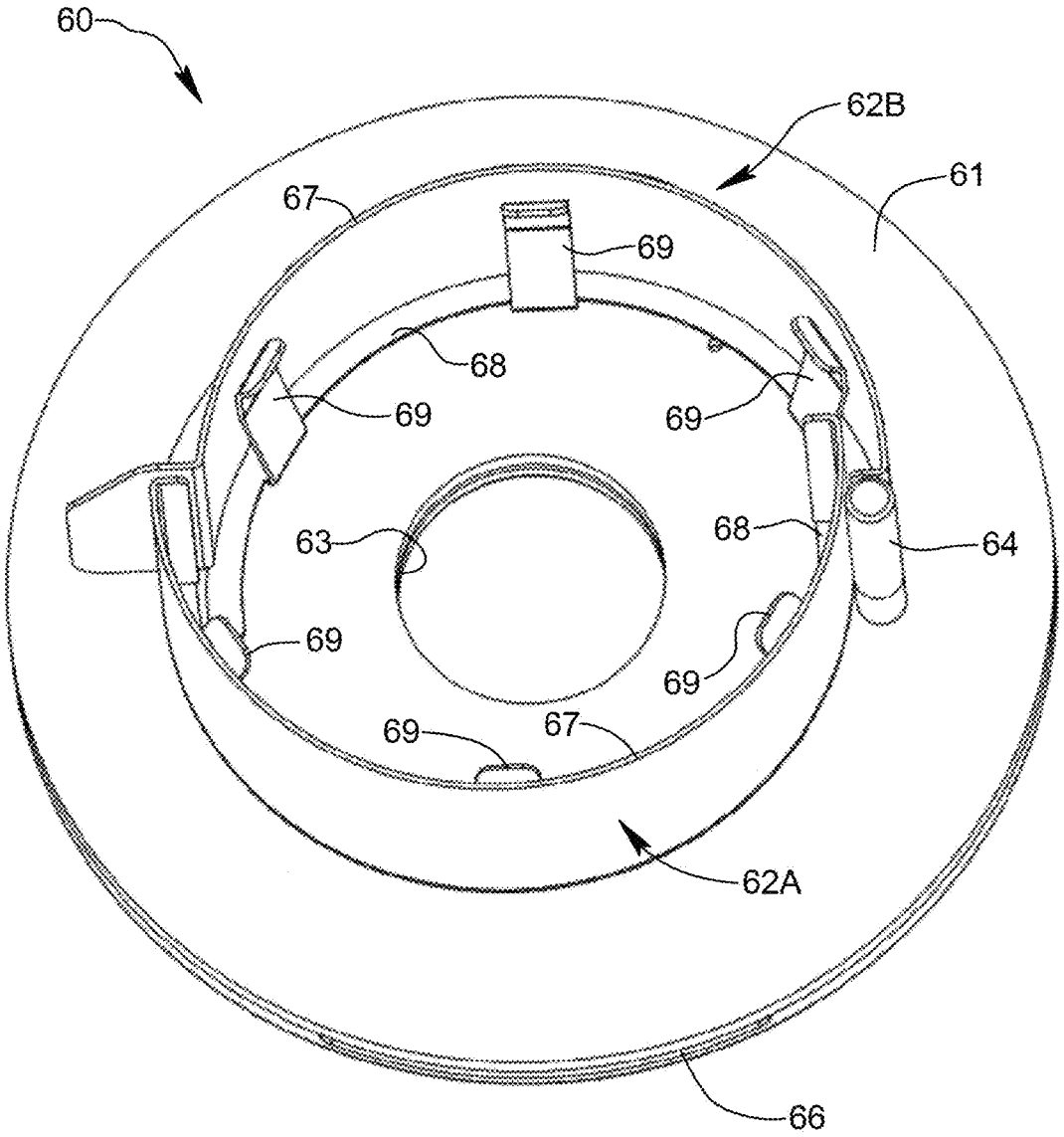
FIG. 6 is a perspective view of a base of the housing.

Apparatus 10 may further comprise a housing 50 containing base cup 20 and descent cup 30. Housing 50 may include a base 60, a first wall portion 70 mounted on base 60 in a fixed position, and a second wall portion 80 mounted on base 60 for pivotal motion relative to first wall portion 70 between a closed position in which the first and second wall portions enclose the base cup and the descent cup (see FIG. 3) and an open position allowing access to the base cup and the descent cup (see FIG. 4). As best seen in FIG. 5, first wall portion 70 and second wall portion 80 may be offset from one another in the closed position to define a pair of airflow gaps 82A and 82B through which air enters housing 50 and generates a vortex affecting the flame. First wall portion 70 and second wall portion 80 may each appear as an arc in top plan view. In one embodiment, the arc may be a circular arc encompassing an angle greater than 180°, for example 188°, such that each airflow gap 82A, 82B follows a respective curved channel between first wall portion 70 and second wall portion 80 to provide flow communication between the exterior and interior of housing 50. Alternatively, first wall portion 70 and second wall portion 80 may be non-arcuate in top plan view. First wall portion 70 and second wall portion 80 may each be formed of a transparent or translucent material capable of withstanding heat generated when solid fuel mass SFM is burned, such as glass, high-temperature plastic, or other engineered transparent or translucent materials. To benefit from economies of scale in production, first wall portion 70 and second wall portion 80 may have identical specifications.

Base 60 may include a base platform 61, a first bracket assembly 62A on base platform 61 configured to removably hold first wall portion 70, and a second bracket assembly 62B on base platform 61 configured to removably hold second wall portion 80. Second bracket assembly 62B may be mounted on base platform 61 by a hinge 64 enabling second bracket assembly 62B to pivot relative to first bracket assembly 62A. Either first bracket assembly 62A or second bracket assembly 62B may include a magnet 65, and the other bracket assembly (second bracket assembly 62B or first bracket assembly 62A) may include ferrous material to which magnet 65 is attracted, whereby the first and second bracket assemblies 62A, 62B are biased toward holding the first and second wall portions 70, 80 in the closed position. Each bracket assembly 62A, 62B may include a brace member 67 and a clip plate 68 having a plurality of resiliently deflectable spring clips 69 configured to releasably hold an associated wall portion 70 or 80 against a surface of corresponding brace member 67. Base platform 61 may include a recess or opening 63 sized to receive depression 27 in bottom wall 26 of base cup 20, whereby base cup 20 may be removably positioned at a central location on base platform 61.

Apparatus 10 may further comprise a snuffer 90 which may include a handle portion 91 and an expanded portion 92 at a distal end of handle portion 91. Snuffer 90 is operable by a user to extinguish a flame by placing expanded portion 92 of snuffer 90 over flame orifice 32 of descent cup 30. As shown in the illustrated embodiment, base platform 61 may include a slot 66 configured to slidably receive at least the expanded portion 92 of snuffer 90 to conveniently store snuffer 90 when the snuffer is not in use. Slot 66 may be configured so that a handle portion 91 of snuffer 90 protrudes from base platform 61 when snuffer 90 is stored in slot 66.

Figure 7A:
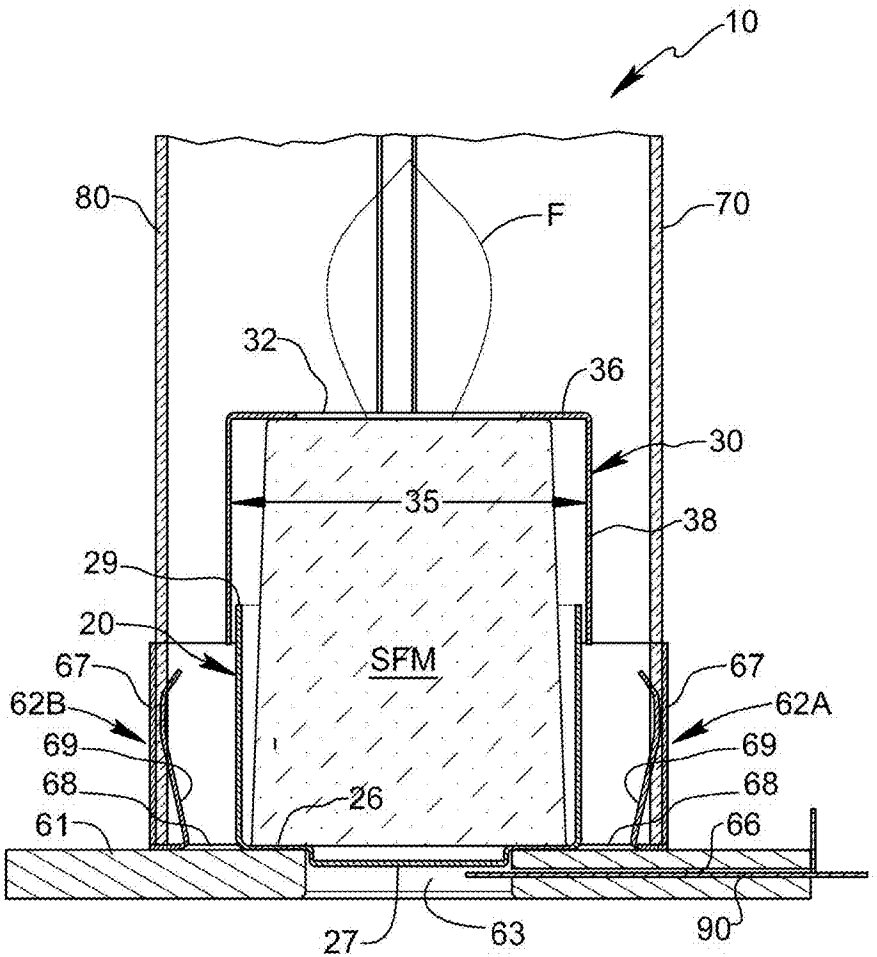
FIG. 7A is a cross-sectional view of the apparatus taken generally along the line A-A in FIG. 5, wherein the apparatus is filled with a new solid fuel mass and the solid fuel mass has just been ignited.

Reference is made now to FIGS. 7A through 7D for describing the use of apparatus 10. Initially, solid fuel mass SFM is loaded into apparatus 10 by pivoting second wall portion 80 to its open position, removing descent cup 30 from base cup 20, inserting a lower portion of solid fuel mass SFM into internal cavity 24 of base cup 20, and placing descent cup 30 over an upper portion of solid fuel mass SFM. Then, solid fuel mass SFM may be ignited using a match, lighter, or other flame source positioned over flame orifice 32. Once solid fuel mass SFM is ignited, the user pivots second wall portion 80 to its closed position to close housing 50. FIG. 7A illustrates operation just after solid fuel mass SFM is ignited and housing 50 is closed, wherein top wall 36 of descent cup 30 rests on a top surface of solid fuel mass SFM. A flame F extends outwardly from flame orifice 32 of descent cup 30 as solid fuel mass SFM is burned.

As may be seen in FIG. 7B, as solid fuel mass SFM is expended by burning, descent cup 30 moves downward toward base cup 20. At this stage, the top surface of solid fuel mass SFM is still higher than top rim 29 of base cup 20.

Figure 7D:
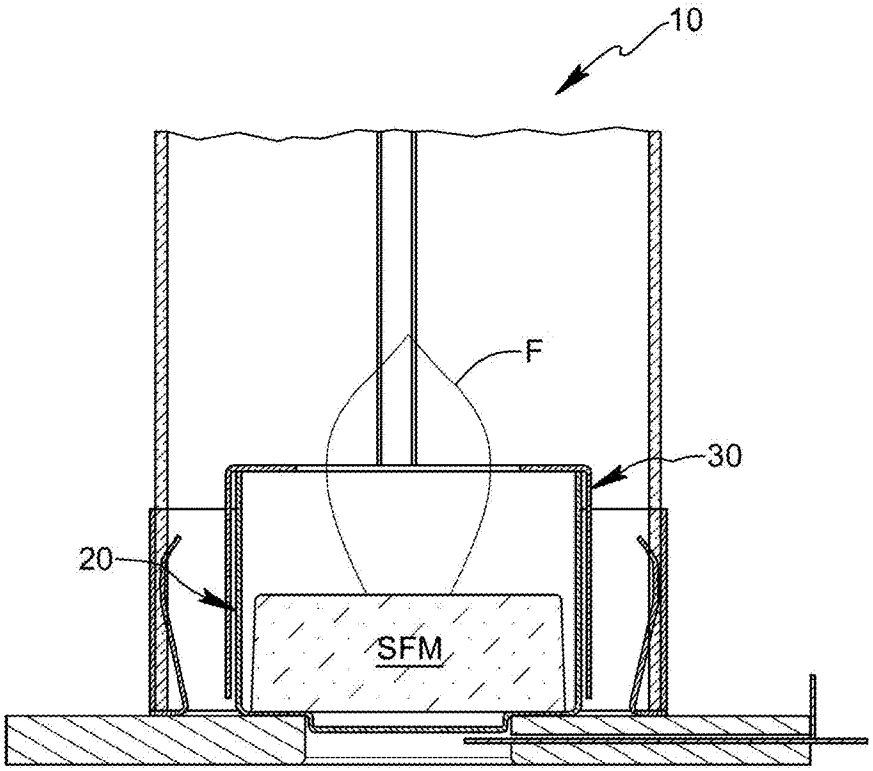
FIG. 7D is a cross-sectional view similar to that of FIG. 7A, wherein the solid fuel mass is expended even more by burning.
Figure 7C:
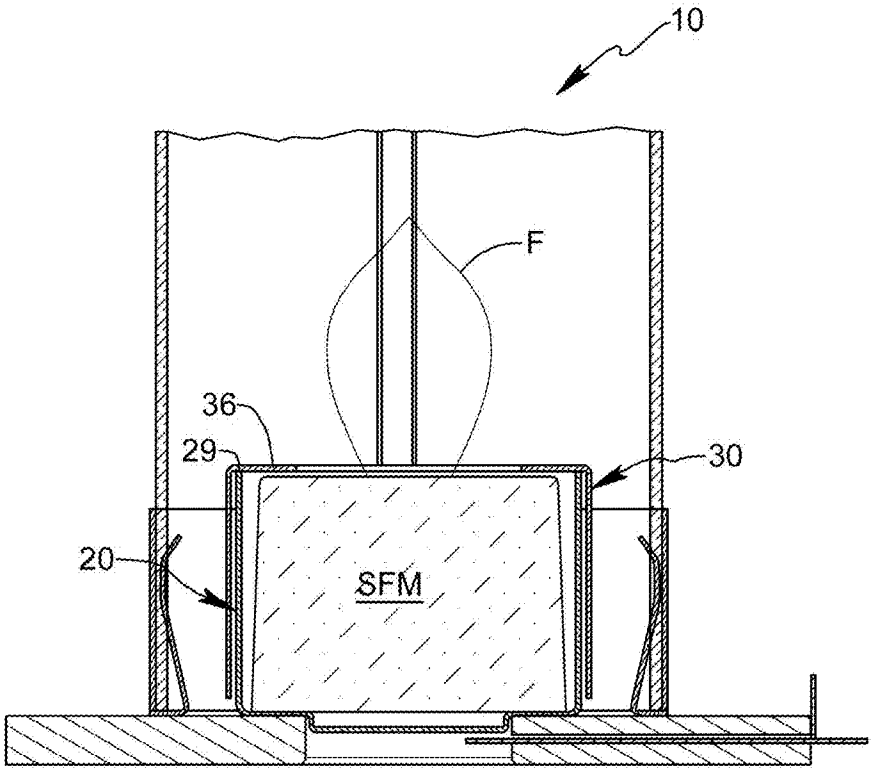
FIG. 7C is a cross-sectional view similar to that of FIG. 7A, wherein the solid fuel mass is further expended by burning.

FIG. 7C shows a condition subsequent to that shown in FIG. 7B as solid fuel mass SFM continues to burn, wherein the top surface of solid fuel mass SFM is just lower than top rim 29 of base cup 20. At this stage, top wall 36 of descent cup 30 engages top rim 29 of base cup 20 and descent cup 30 ceases moving toward base cup 20.

FIG. 7D shows a condition subsequent to that shown in FIG. 7C as solid fuel mass SFM continues to burn. The top surface of solid fuel mass SFM moves downward as fuel is expended, but descent cup 30 remains in the position shown in FIG. 7C.

Figure 7E:
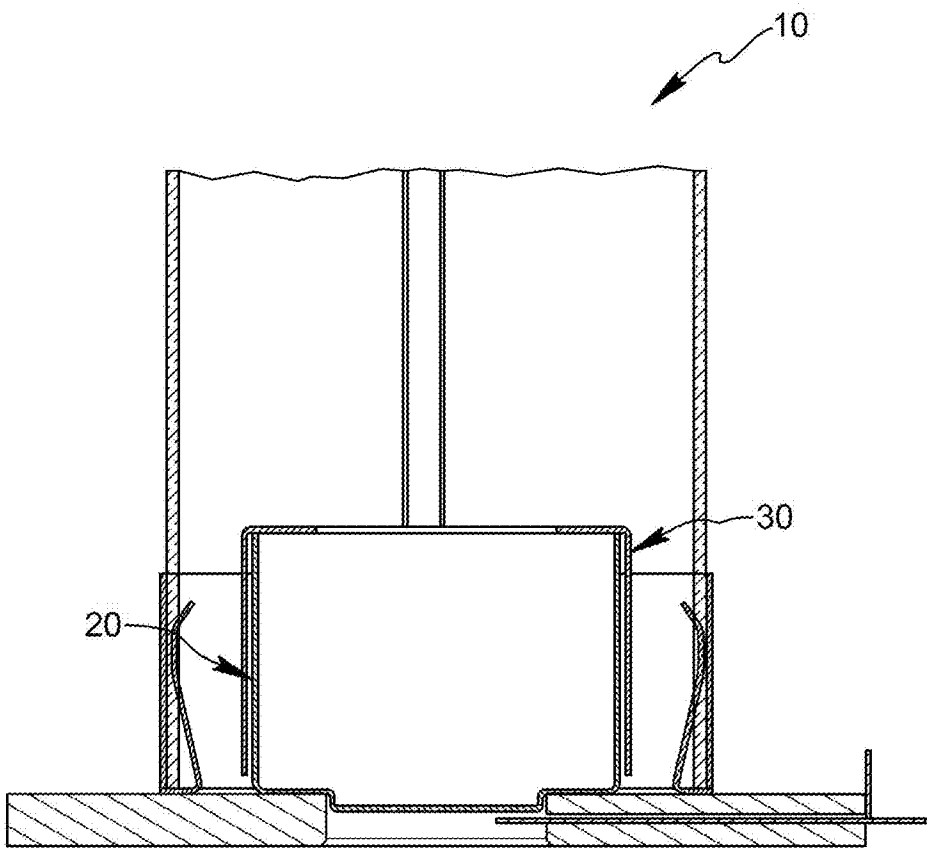
FIG. 7E is a cross-sectional view similar to that of FIG. 7A, wherein the solid fuel mass is completely expended by burning.

Finally, FIG. 7E shows a condition wherein solid fuel mass SFM has been completely expended by burning. Descent cup 30 continues to rest on top rim 29 of base cup 20, and flame F is extinguished for lack of fuel.

The provision of descent cup 30 advantageously slows the rate at which solid fuel mass SFM burns off, thereby causing flame F to last longer. In experiments conducted by applicant, a solid fuel mass lasted about forty-five minutes without the use of descent cup 30, but an equivalent solid fuel mass lasted about three hours with the use of descent cup 30.

While the disclosure describes various exemplary embodiments, the detailed description is not intended to limit the scope of the disclosure to the particular forms set forth. The disclosure is intended to cover such alternatives, modifications and equivalents of the described embodiment as may be apparent to one of ordinary skill in the art.

What is claimed is:

1. An apparatus in which a solid fuel mass is burned, the apparatus comprising:

a base cup configured to receive a lower portion of the solid fuel mass; and a descent cup configured to receive an upper portion of the solid fuel mass, the descent cup including a flame orifice;

wherein the descent cup is telescopically associated with the base cup and moves toward the base cup as the solid fuel mass is burned;

wherein a flame produced as the solid fuel mass is burned extends outwardly from the flame orifice of the descent cup; and wherein the base cup has an external cylindrical shape defined by an outer diameter, and the descent cup has an internal cylindrical shape defined by an inner diameter greater than the outer diameter of the base cup.

2. The apparatus according to claim 1, wherein the descent cup includes a top wall for contacting the solid fuel mass.

3. The apparatus according to claim 2, wherein the flame orifice extends through the top wall of the descent cup.

4. The apparatus according to claim 2, wherein the top wall of the descent cup engages a top rim of the base cup and the descent cup ceases moving toward the base cup when a height of the solid fuel mass decreases to a level lower than the top rim of the base cup as the solid fuel mass is burned.

5. The apparatus according to claim 1, further comprising a housing containing the base cup and the descent cup.

6. The apparatus according to claim 5, wherein the housing includes a base, a first wall portion mounted on the base in a fixed position, and a second wall portion mounted on the base for pivotal motion relative to the first wall portion between a closed position in which the first and second wall portions enclose the base cup and the descent cup and an open position allowing access to the base cup and the descent cup.

7. The apparatus according to claim 6, wherein the first wall portion and the second wall portion are offset from one another in the closed position to define a pair of airflow gaps through which air enters the housing and generates a vortex affecting the flame.

8. The apparatus according to claim 6, wherein the base includes a base platform, a first bracket assembly on the base platform configured to removably hold the first wall portion, and a second bracket assembly on the base platform configured to removably hold the second wall portion, wherein the second bracket assembly is mounted on the base platform by a hinge enabling the second bracket assembly to pivot relative to the first bracket assembly.

9. The apparatus according to claim 8, wherein one of the first bracket assembly and the second bracket assembly includes a magnet, and another of the first bracket assembly and the second bracket assembly includes ferrous material to which the magnet is attracted, whereby the first and second bracket assemblies are biased toward holding the first and second wall portions in the closed position.

10. The apparatus according to claim 8, further comprising a snuffer, wherein the base platform includes a slot for slidably receiving the snuffer when the snuffer is not in use.

11. A method of burning a solid fuel mass, the method comprising:

placing a lower portion of the solid fuel mass in a base cup;

placing a descent cup over an upper portion of the solid fuel mass, the descent cup including a flame orifice;

igniting the solid fuel mass such that a flame extends outwardly from the flame orifice of the descent cup;

allowing the descent cup to descend toward the base cup as the solid fuel mass burns; and stopping the descent of the descent cup in a position wherein the base cup is at least partially received within an interior of the descent cup.

12. The method according to claim 11, wherein the step of stopping the descent of the descent cup occurs once a height of the solid fuel mass decreases to a level below a height of the base cup.

13. The method according to claim 11, further comprising applying a vortex air flow to the flame.

* * * * *